US006505128B1

(12) United States Patent
Shimizu et al.

(10) Patent No.: US 6,505,128 B1
(45) Date of Patent: Jan. 7, 2003

(54) APPARATUS AND METHOD FOR JUDGING CYLINDERS OF AN ENGINE

(75) Inventors: Hirokazu Shimizu, Atsugi (JP); Kenichi Machida, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 112 days.

(21) Appl. No.: 09/703,681

(22) Filed: Nov. 2, 2000

(30) Foreign Application Priority Data

Nov. 2, 1999 (JP) ..... 11-313029

(51) Int. Cl.[7] ..... F02P 5/00

(52) U.S. Cl. ..... 702/33; 701/101; 123/406.18; 123/406.58; 123/406.61

(58) Field of Search ..... 702/33; 73/116, 73/117.3, 117.2, 118.1; 701/101; 123/90.15, 90.17, 406.61, 406.58, 406.18, 612, 406.65, 609

(56) References Cited

U.S. PATENT DOCUMENTS 5,067,462 A * 11/1991 Iwata et al. ..... 123/406.26
5,209,202 A 5/1993 Maurer et al.
5,263,450 A 11/1993 Hashimoto et al.
5,522,256 A * 6/1996 Hashimoto et al. ..... 73/116
5,548,995 A * 8/1996 Clinton et al. ..... 701/99
5,979,413 A * 11/1999 Ohnuma et al. ..... 123/406.58

FOREIGN PATENT DOCUMENTS

| | | |
|---|---|---|
| DE | 42 21 308 | 1/1993 |
| DE | 41 25 675 | 2/1993 |
| JP | 05-106500 | 4/1993 |
| JP | 10-030488 | 2/1998 |

* cited by examiner

*Primary Examiner*—Kamini Shah
*Assistant Examiner*—Hien Vo
(74) *Attorney, Agent, or Firm*—Sughrue Mion, PLLC

(57) ABSTRACT

A plurality of cam sensors are provided for outputting cylinder judgment signals and the output number of cylinder judgment signals between reference crank angle positions are counted for each cam sensor, to thereby perform cylinder judgment based on combination of the output number of the counted cylinder judgment signals.

14 Claims, 9 Drawing Sheets

FIG.3

| RESULT OF CYLINDER JUDGMENT | PHASE 1 INPUT NUMBER | PHASE 2 INPUT NUMBER |
|---|---|---|
| #1cyl | 0 | 0 |
| #3cyl | 1 | 0 |
| #4cyl | 1 | 1 |
| #2cyl | 0 | 1 |
| ERROR | EXCEPT THE ABOVE | |

| RESULT OF CYLINDER JUDGMENT | PHASE 1 INPUT NUMBER | PHASE 2 INPUT NUMBER |
|---|---|---|
| #1cyl | 1 | 1 |
| #3cyl | 2 | 1 |
| #4cyl | 2 | 2 |
| #2cyl | 1 | 2 |
| ERROR | EXCEPT THE ABOVE | |

FIG.8

| RESULT OF CYLINDER JUDGMENT | PHASE 1 INPUT NUMBER | PHASE 2 INPUT NUMBER |
|---|---|---|
| #1cyl | 0 | 1 |
| #2cyl | 1 | 0 |
| #3cyl | 1 | 1 |
| #4cyl | 2 | 0 |
| #5cyl | 2 | 1 |
| #6cyl | 2 | 2 |
| ERROR | EXCEPT THE ABOVE | |

APPARATUS AND METHOD FOR JUDGING CYLINDERS OF AN ENGINE

FIELD OF THE INVENTION

The present invention relates to an apparatus and a method for performing cylinder judgment of an engine based on the output number of cylinder judgment signals between reference crank angle positions.

RELATED ART

Conventionally, there has been a cylinder judgment apparatus for performing cylinder judgment based on the output number of cylinder judgment signals between reference crank angle positions as disclosed in Japanese Unexamined Patent Publication No. 5-106500 or No. 10-030488.

In Japanese Unexamined Patent Publication No. 5-106500, the constitution is such that the cylinder judgment signals of the number corresponding to the number of cylinders between reference crank angle positions are output.

The apparatus disclosed in Japanese Unexamined Patent Publication No. 10-030488 has two cam sensors. The cylinder judgment is carried out based on the number of signals output between the reference crank angle positions from one of the two cam sensors. When the cylinder judgment cannot be carried out based on the number of signals from the one cam sensor, the cylinder judgment is carried out based on the number of signals from the other cam sensor.

As disclosed in Japanese Unexamined Patent Publication No. 5-106500, however, if the cylinder judgment signals of the number corresponding to the number of cylinders is output, for instance, in a six cylinder engine, a cylinder plate for outputting the cylinder judgment signals requires six portions to be detected at a maximum between the reference crank angle positions. Therefore, in such a constitution that a magnetic sensor is used to detect projections formed on a signal plate, the signal plate cannot be miniaturized.

In the apparatus disclosed in Japanese Unexamined Patent Publication No. 10-303488, it is required that a specific cylinder can be identified based only on a signal from the one cam sensor. Therefore, there is a small degree of freely setting the number of cylinder judgment signals.

SUMMARY OF THE INVENTION

In view of the foregoing problems, the present invention has been achieved and has an object of providing an apparatus and a method for judging cylinders wherein cylinder judgment can be carried out with a small number of portions to be detected which are to be formed on a signal plate of a cam sensor, and a high degree of freely setting the number of cylinder judgment signals can be obtained.

For achieving the above object, the present invention is constituted so that a plurality of cam sensors are provided, and the output number of cylinder judgment signals between reference crank angle positions are counted up for each of the plurality of cam sensors to carry out cylinder judgment based on combinations of the output number of the counted cylinder judgment signals.

According to the above constitution, where there are a first cam sensor and a second cam senor as the cam sensor, if each of the cam sensors outputs the cylinder judgment signal of 0 or 1 between the reference crank angle positions, four pattern combinations of 2×2 can be produced, thereby capable of distinguishing the cylinders into 4.

Accordingly, it is not required for one cam sensor to output the cylinder judgment signal in the same kind of pattern as the number of cylinders so that the number of portions to be detected formed on the signal plate can be reduced to make the diameter of the signal plate small. Further, the number of cylinder judgment signals to be output from a single cam sensor is not required to correspond to a specific cylinder. Thus, a high degree of freely setting the number of cylinder judgment signals can be achieved.

Here, a cam sensor may be disposed on each of an intake side camshaft and an exhaust side camshaft of an engine. Further, a cam sensor may be disposed on each bank of a V-type engine.

Also, in a case that a valve timing is changed with a change in a rotation phase of a camshaft relative to a crankshaft, the constitution may be such that the cam sensor disposed on the camshaft, whose rotation phase is controlled, outputs at least one cylinder judgment signal between the reference crank angle positions, to thereby detect the rotation phase based on a phase difference between the cylinder judgment signal from the cam sensor disposed on the camshaft, whose rotation phase is controlled, and the reference crank angle position.

Further, a crank angle sensor may be disposed for outputting a unit angle signal for each unit crank angle, the sensor being constituted not to output the unit angle signal for each stroke phase difference between cylinders. The position where the crank angle sensor did not output the unit angle signal is judged based on the period of the unit angle signals to be detected as the reference crank angle position.

The other objects and features of the present invention will be understood from the following description of the embodiments with reference to the accompanying drawings.

BRIEF EXPLANATION OF THE DRAWINGS

FIG. 3 is a diagram showing a cylinder judgment pattern in the output characteristics in FIG. 2;

FIG. 8 is a diagram showing a cylinder judgment pattern in the output characteristics in FIG. 7;

DESCRIPTION OF THE PREFERRED EMBODIMENTS

Embodiments according to the present invention will be explained as follows.

Figure 1:
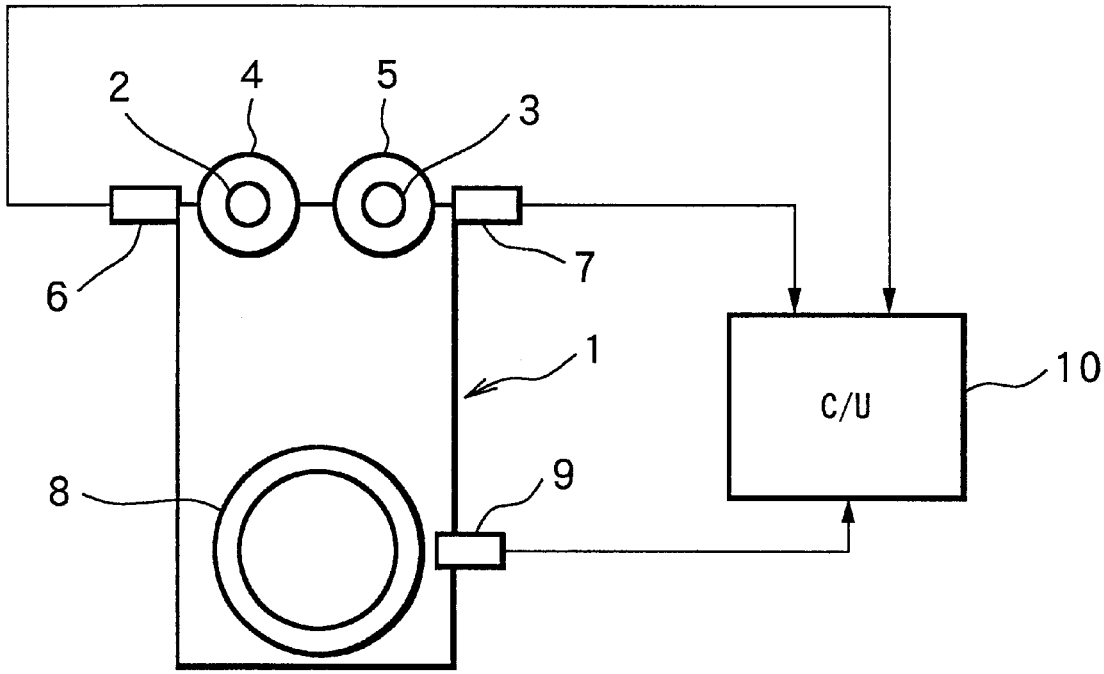
FIG. 1 is a diagram showing a system structure of a four cylinder in line engine in an embodiment.

An engine 1 shown in FIG. 1 is a four cylinder in line engine and is equipped with an intake side camshaft 2 and an exhaust side camshaft 3.

Signal plates 4, 5 are axially supported to the intake side camshaft 2 and the exhaust side camshaft 3, respectively. A first magnetic cam sensor 6 is provided for detecting a projection (not shown in the figure) formed on the signal plate 4 to output a cylinder judgment signal Phase 1, and a second magnetic cam sensor 7 is provided for detecting a projection (not shown in the figure) formed on the signal plate 5 to output a cylinder judgment signal Phase 2.

Further, a magnetic crank angle sensor 9 is provided for detecting a projection (not shown in the figure) formed on a signal plate 8 mounted on a crank pulley to output a position signal POS (unit angle signal) for each unit angle.

Detection signals from the first cam sensor 6, the second cam sensor 7 and the crank angle sensor 9 are input to a control unit 10. The control unit 10 carries out cylinder judgment based on the detection signals to control fuel injection or ignitions in the engine based on results of cylinder judgment.

In a case that the engine is equipped with a valve timing control apparatus for changing a valve timing with an operation angle being constant by changing a rotation phase of the camshaft relative to the crankshaft, the rotation phase is detected based on the above detection signals to feedback control the rotation phase.

The signal plate 8 is provided with projections for each 10° CA. At the position of 180° CA (BTDC 60° of each cylinder) corresponding to a stroke phase difference between cylinders, the projections are not provided so that, as shown in FIG. 2, the position signal POS is not generated at each 180° CA (BTDC 60° of each cylinder) corresponding to the stroke phase difference between cylinders.

Here, the position of no position signal POS corresponds to a reference crank angle position in the present embodiment. The reference crank angle position is detected by detecting the position of no signal.

Alternatively, a sensor for outputting a reference angle signal for each reference crank angle position may be provided.

Figure 2:
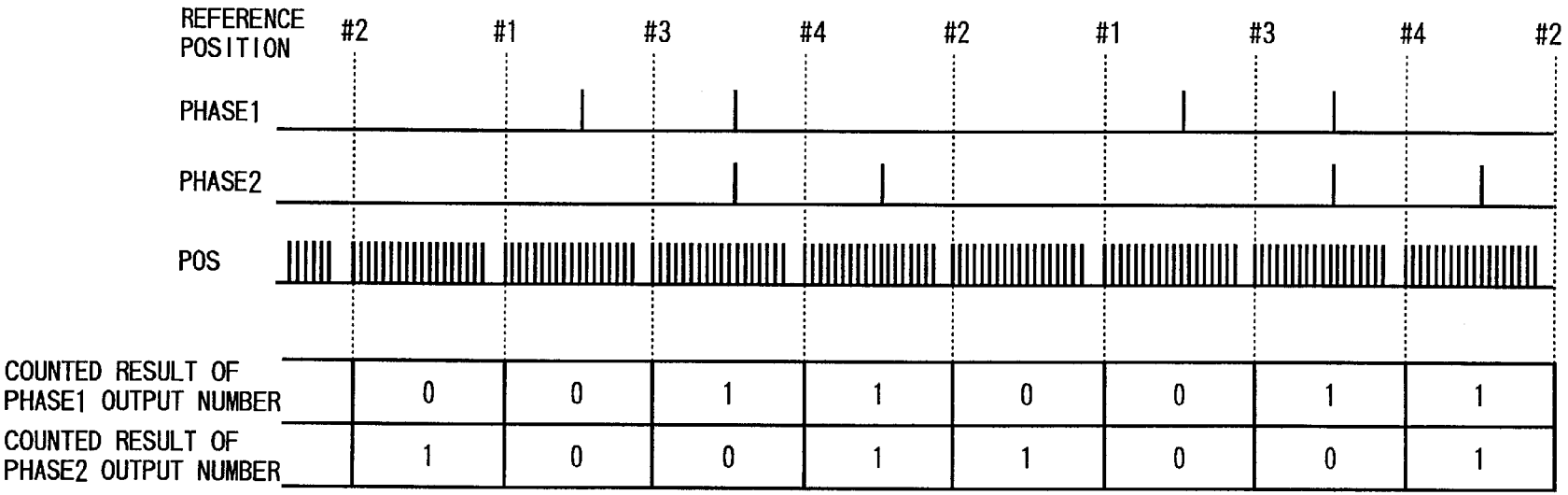
FIG. 2 is a time chart showing the output characteristics of a detection signal in the four cylinder in line engine.

On the other hand, the cylinder judgment signal Phase 1 from the first magnetic cam sensor 6 and the cylinder judgment signal Phase 2 from the second magnetic cam sensor 7 are output by 0 or 1 between the reference crank angle positions, as shown in FIG. 2. Combination patterns of the output number of cylinder judgment signals Phase 1 and Phase 2 are four. Each of the combination patters is made to correspond to each cylinder so that the corresponding cylinder number among the four cylinders can be judged depending on which of the combination patterns is adapted to output the cylinder judgment signals Phase 1 and Phase 2.

Concretely, a single cylinder judgment signal Phase 1 is output between the reference crank angle position corresponding to #1 cylinder and the reference crank angle position corresponding to #3 cylinder. A single cylinder judgment signal Phase 2 is output between the reference crank angle position corresponding to #3 cylinder and the reference crank angle position corresponding to #4 cylinder, and is also output between the reference crank angle position corresponding to #4 cylinder and the reference crank angle position corresponding to #2 cylinder. An order of ignition is #1→#3→#4→#2.

Accordingly, if the output number of cylinder judgment signals Phase 1 and Phase 2 between the reference crank angle positions are counted up to judge the combination of the output number of cylinder judgment signals Phase 1 and Phase 2 for each reference crank angle position, when the combination of cylinder judgment signals Phase 1 and Phase 2 is (0-0), the reference crank angle position at the time of judgment is judged to correspond to #1 cylinder. When (1-0), it is judged to correspond to #3 cylinder, when (1-1), it is judged to correspond to #4 cylinder and when (0-1), it is judged to correspond to #2 (refer to FIG. 3).

In a case that the engine is equipped with a valve timing control apparatus for changing a valve timing with an operation angle being constant by changing the rotation phase of the camshaft relative to the crankshaft, the rotation phase (valve timing) of the camshaft can be detected as a phase difference between the reference crank angle position and the cylinder judgment signals Phase 1 and Phase 2. However, when the cylinder judgment signals Phase 1 and Phase 2 are output between the reference crank angle positions, the rotation phase cannot be detected.

Figure 4:
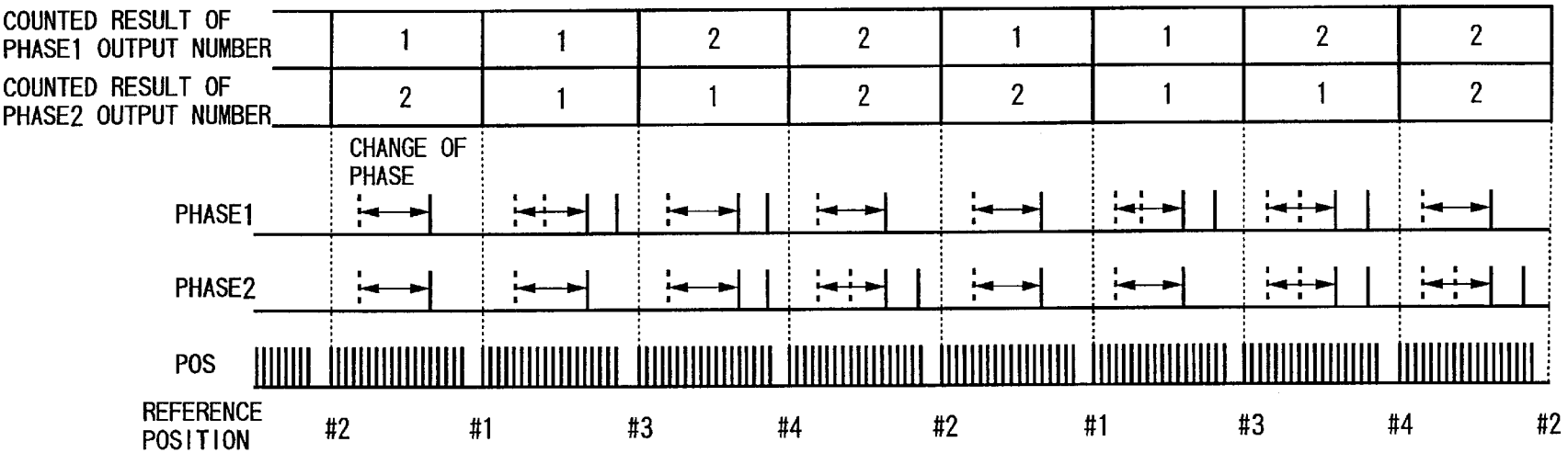
FIG. 4 is a time chart showing the output characteristics of the detection signal in the case that a rotation phase detection of a camshaft is carried out in the four cylinder in line engine.

Therefore, where the valve timing control apparatus is provided on each of the intake side camshaft 2 and the exhaust side camshaft 3, the cylinder judgment signals Phase 1 and Phase 2 are output as shown in FIG. 4.

In the output characteristics in FIG. 4, compared with the output characteristics of cylinder judgment signals Phase 1 and Phase 2 shown in FIG. 2, the output numbers of cylinder judgment signals Phase 1 and Phase 2 between the reference crank angle positions are increased by 1, respectively, so that at least one cylinder judgment signal of Phase 1 and Phase 2 is output between the respective reference crank angle positions. As a result, one or two cylinder judgment signals of Phase 1 and Phase 2 are output between the reference crank angle positions. Further, even if the rotation phases of the camshafts 2 and 3 are changed, the output positions do not change beyond the reference crank angle position. Also, the leading cylinder judgment signals Phase 1 and Phase 2 output immediately after the reference crank angle position are always output at the same angle from the reference crank angle position.

Figures 5, 6:
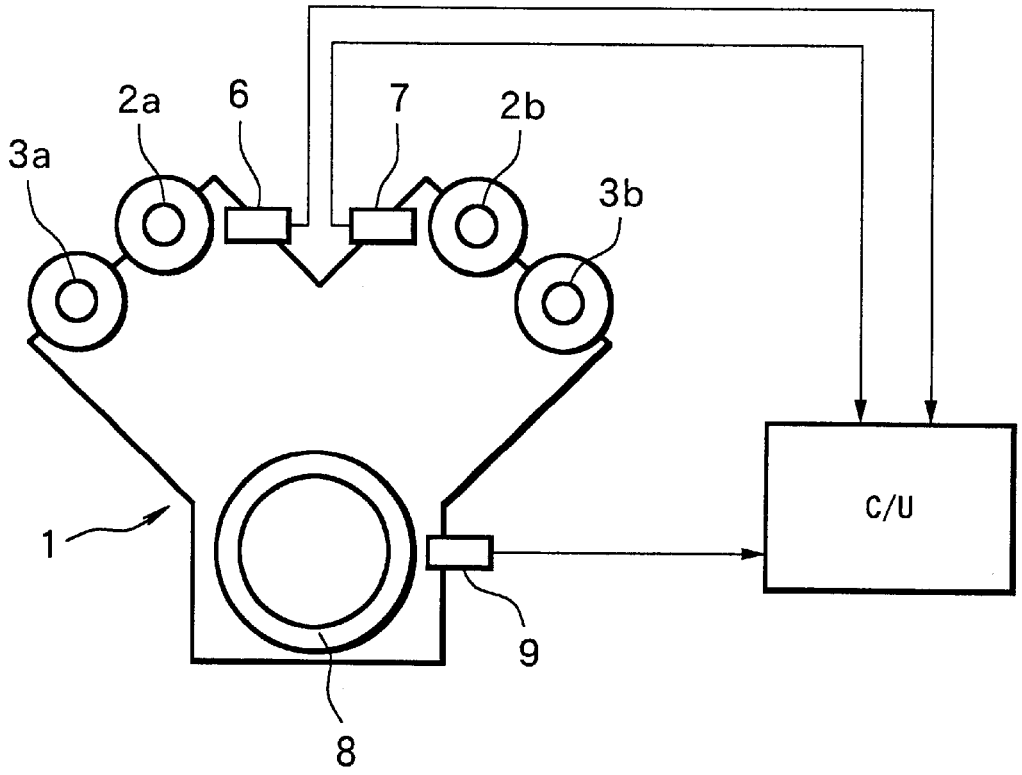
FIG. 5 is a diagram showing a cylinder judgment pattern in the output characteristics in FIG. 4.
FIG. 6 is a diagram showing a system structure of a V-type six cylinder engine in the embodiment.

The combinations of the output number of cylinder judgment signals Phase 1 and Phase 2 between the reference crank angle positions are shown in FIG. 5. All of the four cylinders are judged depending on whether the combination pattern of the output number is (1-1), (2-1), (2-2) or (1-2).

Further, since an angle from the reference crank angle position to the leading cylinder judgment signals Phase 1 and Phase 2 is changed with a change in rotation phases of the camshafts 2, 3 relative to the crankshaft, if the angle from the reference crank angle position to the leading cylinder judgment signals Phase 1 and Phase 2 is detected by measuring the output number or the time of position signals POS during the change of angle, the rotation phases (valve timing) of the camshafts 2, 3 can be detected for each reference crank angle position.

The above embodiment shows the case wherein the present invention is applied to the four cylinder in line engine, however, the cylinder judgment and the detection of rotation phase of camshaft may also be carried out, for example, in a V-type six cylinder engine.

FIG. 6 shows the positions where the first cam sensor 6 and the second cam sensor 7 are provided in a V-type six cylinder engine. Among intake side camshafts 2*a* and 2*b*, and exhaust side camshafts 3*a* and 3*b* which are provided on each bank, the intake side camshafts 2*a* and 2*b* are provided with the first cam sensor 6 and the second cam sensor 7, respectively.

However, the first cam sensor 6 and the second cam sensor 7 may be disposed on the intake side camshaft 2*a* and the exhaust side camshaft 3*a* of one of the banks.

Figure 7:
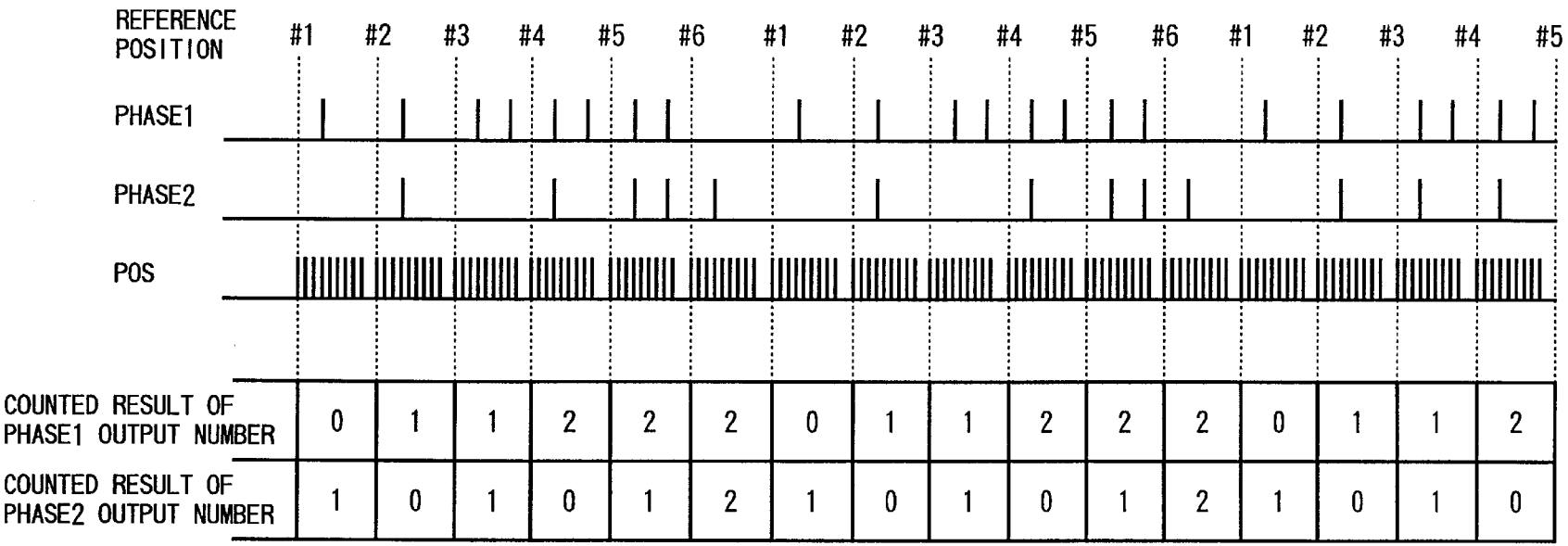
FIG. 7 is a time chart showing the output characteristics of a detection signal in the V-type six cylinder engine.

FIG. 7 shows the output characteristics of the first cam sensor 6, the second cam sensor 7 and the crank angle sensor 9, in the V-type six cylinder engine. The position signal POS is not generated at each 120° CA corresponding to the stroke phase difference between cylinders. The reference crank angle position is detected by detecting the position of no signal.

On the other hand, the cylinder judgment signal Phase 1 is output for one between the reference crank angle position of #1 and the reference crank angle position of #2, for one between the reference crank angle position of #2 and the reference crank angle position of #3, for two between the reference crank angle position of #3 and the reference crank angle position of #4, for two between the reference crank angle position of #4 and the reference crank angle position of #5, for two between the reference crank angle position of #5 and the reference crank angle position of #6, and for zero between the reference crank angle position of #6 and the reference crank angle position of #1.

Further, the cylinder judgment signal Phase 2 is output for zero between the reference crank angle position of #1 and the reference crank angle position of #2, for one between the reference crank angle position of #2 and the reference crank angle position of #3, for zero between the reference crank angle position of #3 and the reference crank angle position of #4, for one between the reference crank angle position of #4 and the reference crank angle position of #5, for two between the reference crank angle position of #5 and the reference crank angle position of #6, and for one between the reference crank angle position of #6 and the reference crank angle position of #1.

Accordingly, the combination patterns of the output number of cylinder judgment signals Phase 1 and Phase 2 are six. The cylinder judgment can be carried out for each cylinder depending on which of the combination patterns is adapted to output the cylinder judgment signals Phase 1 and Phase 2.

In a case that the camshaft provided with the first cam sensor and the second cam sensor is a camshaft whose rotation phase relative to the crankshaft is variably controlled, all of the output numbers of cylinder judgment signals Phase 1 and Phase 2 shown in FIGS. 7 and 8 are increased by one, so that at least one cylinder judgment signal of Phase 1 or Phase 2 is output between the respective reference crank angle positions, and the leading cylinder judgment signals Phase 1 and Phase 2 output between the respective reference crank angle positions are all output at the same angle from the respective reference crank angle positions, and further, even if the rotation phase of camshaft is changed, the output positions of cylinder judgment signal of Phase 1 and Phase 2 do not change beyond the reference crank angle position. Then, by detecting the angle from the reference crank angle position to the leading cylinder judgment signals Phase 1 and Phase 2, the rotation phase (valve timing) of the camshaft can be detected for each reference crank angle position.

Next, a cylinder judgment control based on combination patterns of the output number of cylinder judgment signals Phase 1 and Phase 2 between the reference crank angle positions will be explained in detail according to flowcharts.

Figure 9:
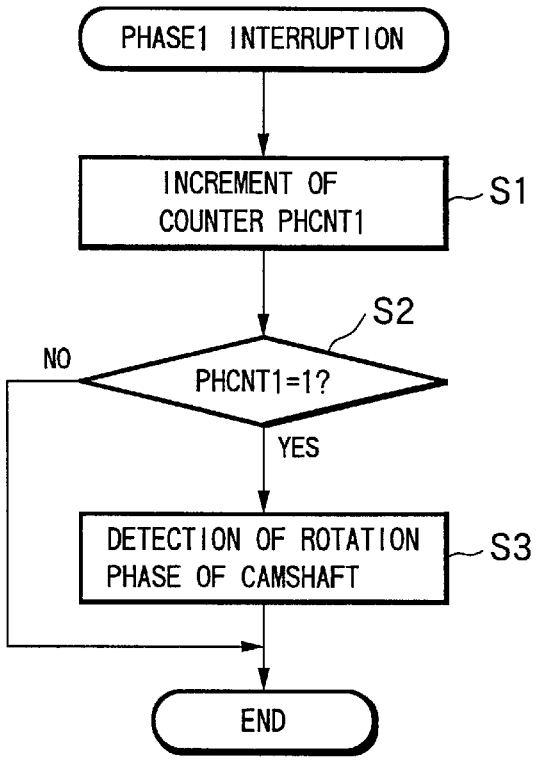
FIG. 9 is a flowchart showing a counting process of a cylinder judgment signal Phase 1 between reference crank angle positions.

A flowchart in FIG. 9 is a control routine to be interruptedly executed at each output of cylinder judgment signal Phase 1. In step 1, a counter PHCNT1 for counting the output number of cylinder judgment signal Phase 1 is incremented by one.

In next step 2, it is judged whether or not the counter PHCNT1 is 1 to judge whether or not the cylinder judgment signal is the leading cylinder judgment signal Phase 1 immediately after the reference crank angle position.

If the counter PHCNT1 is 1, the process goes to step 3, wherein the rotation phase (valve timing) of the camshaft is detected based on the angle from the just before reference crank angle position to the leading cylinder judgment signal Phase 1.

Figure 10:
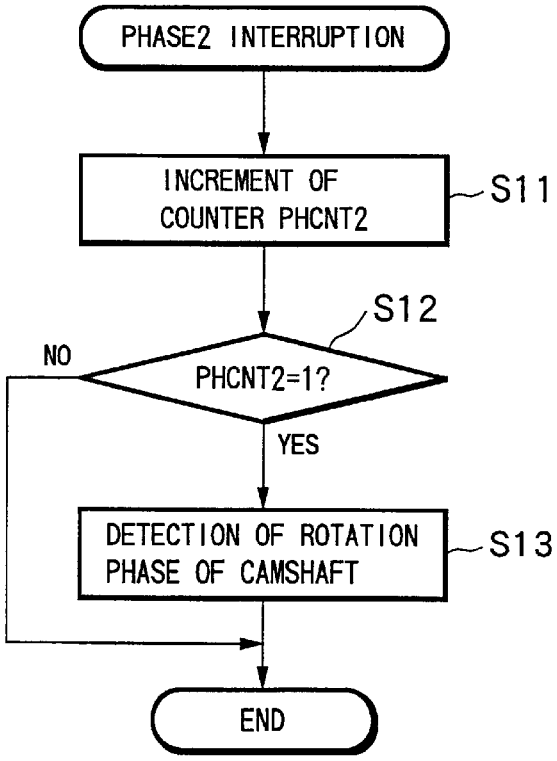
FIG. 10 is a flowchart showing a counting process of a cylinder judgment signal Phase 2 between reference crank angle positions.

A flowchart in FIG. 10 is a control routine to be interruptedly executed at each output of cylinder judgment signal Phase 1. Similarly to the flowchart in FIG. 9, in step 11, a counter PHCNT2 for counting the output number of cylinder judgment signal Phase 2 is incremented by one. Then, in next step 12, it is judged whether or not the counter PHCNT 2 is 1. If the counter PHCNT2 is 1, the process goes to step 13, wherein the rotation phase (valve timing) of the camshaft is detected based on the angle from the just before reference crank angle position to the leading cylinder judgment signal Phase 2.

If the detection of the rotation phase (valve timing) of the camshaft is not required, the processes of the above steps 2, 3, 12 and 13 may be omitted.

Figure 11:
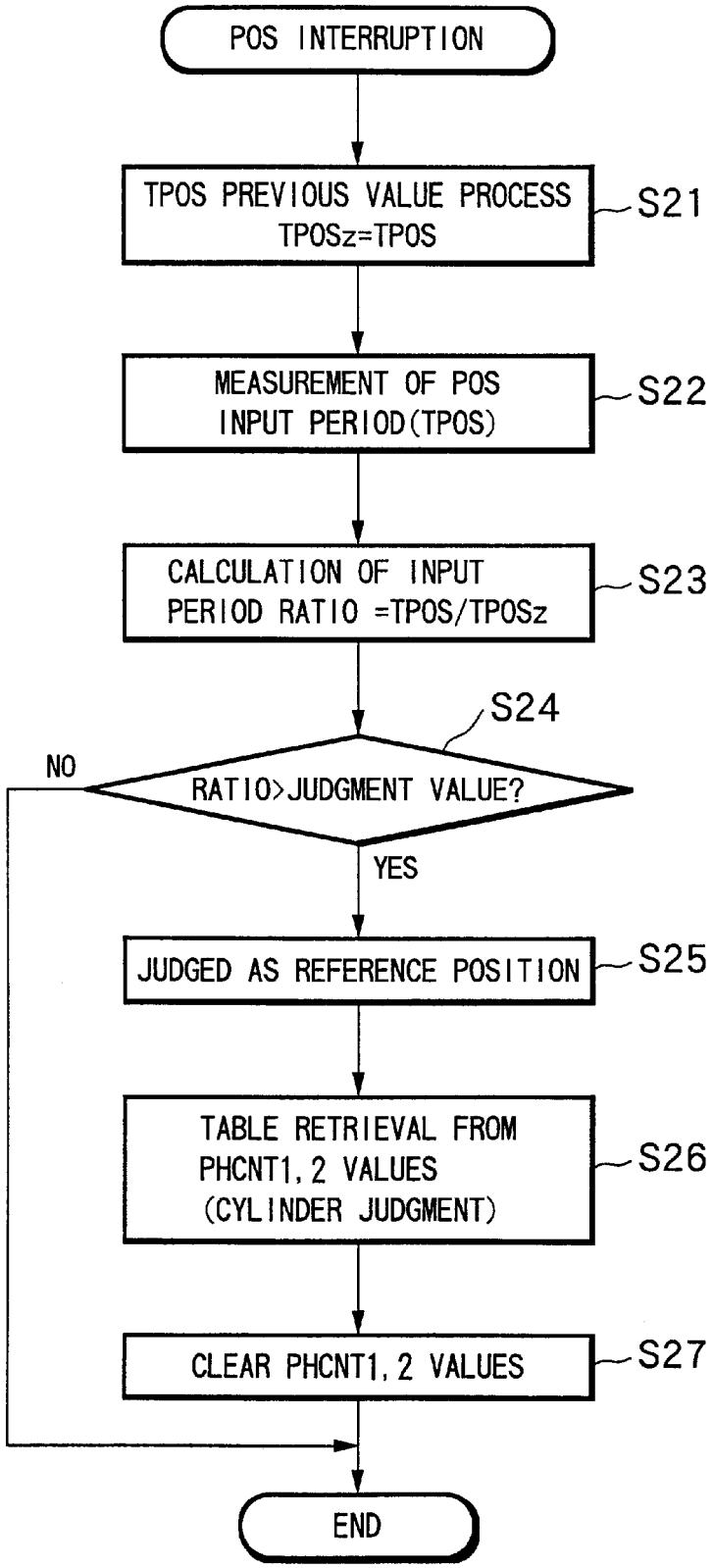
FIG. 11 is a flowchart showing a cylinder judgment process based on the counted values of the cylinder judgment signals Phase 1 and Phase 2.

A flowchart in FIG. 11 is a control routine to be interruptedly executed at each output of position signal POS. In step 21, an output period TPOS of the position signal POS is set to the previous value TPOSz, and then in next step 22, the newest period TPOS is obtained.

In step 23, period ratio=TPOS/TPOSz is calculated, and in step 24, it is judged whether or not the period ratio exceeds a judgment level to judge whether it is the position of no signal.

If the period ratio is equal to or below the judgment level, the present routine is terminated. If it is judged that the period ratio exceeds the judgment level, then the process goes to step 25, wherein the reference crank angle position is judged.

In step 26, the cylinder judgment (cylinder judgment corresponding to the present reference crank angle position) is carried out by referring tables as shown in FIGS. 3, 5 and 8 based on the counters PHCNT1 and PHCNT2 for counting the output number of cylinder judgment signals Phase 1 and Phase 2.

In step 27, the counters PHCNT1 and PHCNT2 are cleared so that the output number of cylinder judgment signals Phase 1 and Phase 2 between the next reference crank angle positions are counted.

The entire content of Japanese Patent Application No. 11-313029 filed on Nov. 2, 1999 is incorporated herein by reference.

What is claimed:

1. A cylinder judgment apparatus of an engine, comprising:

reference crank angle position detector for detecting a reference crank angle position for each stroke phase difference between cylinders;

a plurality of cam sensors each disposed with respect to a respective camshaft, for outputting cylinder judgment signals between said reference crank angle positions;

counting means for counting the output number of said cylinder judgment signals between said reference crank angle positions for each of said plurality of cam sensors and generating an output count for each cam sensor; and cylinder judgment means for performing cylinder judgment and uniquely identifying each cylinder based on combinations of the output counts for each cam sensor.

2. A cylinder judgment apparatus of an engine according to claim 1, wherein said engine is provided with an intake side camshaft and an exhaust side camshaft and said cam sensor is disposed to each cam shaft.

3. A cylinder judgment apparatus of an engine according to claim 1, wherein said engine is a V-type engine and said cam sensor is disposed to each bank.

4. A cylinder judgment apparatus of an engine according to claim 1, wherein there is provided a valve timing apparatus for changing a valve timing with a change in a rotation of a camshaft relative to a crankshaft, said cam sensor, which is disposed to the camshaft whose rotation phase is controlled, outputs at least one cylinder judgment signal between said reference crank angle positions, and said apparatus further comprises a rotation phase detecting means for detecting said rotation phase based on a phase difference between the cylinder judgment signal from the cam sensor disposed to the camshaft whose rotation phase is controlled and said reference crank angle position.

5. A cylinder judgment apparatus of an engine according to claim 1, wherein said engine is a four cylinder engine provided with a camshaft whose rotation phase relative to a crankshaft is variably controlled and a cam shaft whose rotation phase relative to the crankshaft is fixed, said cam sensor and counting means are disposed to each camshaft, said cam sensor disposed to said camshaft whose rotation phase is variably controlled outputs one or two cylinder judgment signals between said reference crank angle positions, there is provided rotation phase detecting means for detecting said rotation phase based on a phase difference between the cylinder judgment signal which is output for at least one between said reference crank angle positions and said reference crank angle position, and said cam sensor disposed to said camshaft whose rotation phase is fixed outputs zero or one cylinder judgment signal between said reference crank angle positions.

6. A cylinder judgment apparatus of an engine according to claim 1, wherein said engine is a six cylinder engine provided with a camshaft whose rotation phase relative to a crankshaft is variably controlled and a camshaft whose rotation phase relative to the crankshaft is fixed, said cam sensor and counting means are disposed to each camshaft, said cam sensor, which is disposed to said camshaft whose rotation phase is variably controlled, outputs one to three cylinder judgment signals between said reference crank angle positions, there is provided rotation phase detecting means for detecting said rotation phase based on a phase difference between the cylinder judgment signal which is output for at least one between said reference crank angle positions and said reference crank angle position, and said cam sensor, which is disposed to said camshaft whose rotation phase is fixed, outputs zero to two cylinder judgment signals between said reference crank angle positions.

7. A cylinder judgment apparatus of an engine, comprising:

a crank angle sensor disposed to a crankshaft for outputting a unit angle signal for each unit crank angle constituted not to generate said unit angle signal at a stroke phase difference between cylinders;

period measuring means for measuring a period of said unit angle signal;

reference crank angle position detecting means for detecting a position of no unit angle signal based on the period measured by said period measuring means to judge said detected position as a reference crank angle position;

two cam sensors disposed to a camshaft for outputting cylinder judgment signals between said reference crank angle positions;

counting means for counting the number of said outputted cylinder judgment signals between said reference crank angle positions for each of two cam sensors and generating a respective output count for each cam sensor; and cylinder judgment means for performing cylinder judgment and uniquely identifying each cylinder based on a combination of the output counts for each cam sensor.

8. A cylinder judgment method of an engine, comprising the steps of:

detecting a reference crank angle position for each stroke phase difference between cylinders;

counting cylinder judgment signals output from each of a plurality of cam sensors between said reference crank angle positions and generating an output number; and performing a cylinder judgment and uniquely identifying each cylinder based on a combination of the output number of said counted cylinder judgment signals.

9. A cylinder judgment method of an engine according to claim 8, wherein said cam sensor is disposed to an intake side camshaft and an exhaust side camshaft.

10. A cylinder judgment method of an engine according to claim 8, wherein said cam sensor is disposed to each bank of a V-type engine.

11. A cylinder judgment method of an engine according to claim 8, wherein a cam sensor disposed to a camshaft whose rotation phase relative to a crankshaft is variably controlled outputs at least one cylinder judgment signal between said reference crank angle positions, and said rotation phase is detected based on a phase difference between the cylinder judgment signal from the cam sensor disposed to the camshaft whose rotation phase is changed and said reference crank angle position.

12. A cylinder judgment method of an engine according to claim 8, wherein said engine is a four cylinder engine provided with a camshaft whose rotation phase relative to a crankshaft is variably controlled and a cam shaft whose rotation phase relative to the crankshaft is fixed, said cam sensor disposed to said camshaft whose rotation phase is variably controlled outputs one or two cylinder judgment signals between said reference crank angle positions, said rotation phase is detected based on a phase difference between the cylinder judgment signal which is output for at least one between said reference crank angle positions and said reference crank angle position, and said cam sensor disposed to said camshaft whose rotation phase is fixed outputs zero or one cylinder judgment signal between said reference crank angle positions.

13. A cylinder judgment method of an engine according to claim 8, wherein said engine is a six cylinder engine provided with a camshaft whose rotation phase relative to a crankshaft is variably controlled and a cam shaft whose rotation phase relative to the crankshaft is fixed, said cam sensor disposed to said camshaft whose rotation phase is variably controlled outputs one to three cylinder judgment signals between said reference crank angle positions, said rotation phase is detected based on a phase difference between the cylinder judgment signal which is output for at least one between said reference crank angle positions and said reference crank angle position, and said cam sensor disposed to said camshaft whose rotation phase is fixed outputs zero to two cylinder judgment signals between said reference crank angle positions.

14. A cylinder judgment method of an engine according to claim 8, wherein there is provided a crank angle sensor disposed to a crankshaft for outputting a unit angle signal for each unit crank angle constituted not to generate said unit angle signal at a stroke phase difference between cylinders, said step of detecting said reference crank angle position comprises the steps of:

measuring a period of said unit angle signal; and detecting a position of no unit angle signal based on the period measured by said period measuring means to judge said detected position as a reference crank angle position.

* * * * *